United States Patent [19]

Meyer

[11] Patent Number: 4,471,967

[45] Date of Patent: Sep. 18, 1984

[54] ROTARY APPARATUS FLUID SEALING SYSTEM

[75] Inventor: Gero Meyer, Bübingen, Fed. Rep. of Germany

[73] Assignee: Flutec Fluidtechnische Geraete GmbH, Sluzbach, Fed. Rep. of Germany

[21] Appl. No.: 499,476

[22] Filed: May 31, 1983

[30] Foreign Application Priority Data

May 28, 1982 [DE] Fed. Rep. of Germany ... 8215608[U]

[51] Int. Cl.³ ..... F01C 9/00; F16J 1/00

[52] U.S. Cl. ..... 277/165; 92/125

[58] Field of Search ..... 92/120–125; 277/165, 169, 12, 189

[56] References Cited

U.S. PATENT DOCUMENTS

| | | | |
|---|---|---|---|
| 3,030,934 | 4/1962 | Herbst | 92/125 |
| 3,215,046 | 11/1965 | Drake | 92/125 |
| 3,277,796 | 10/1966 | Wessel et al. | 92/125 |
| 3,426,654 | 2/1969 | Laughman | 92/125 |
| 3,526,407 | 9/1970 | Chattin et al. | 277/165 |
| 3,682,050 | 8/1972 | Hyde | 277/169 |
| 4,066,007 | 1/1978 | Barlow | 92/125 |
| 4,239,244 | 12/1980 | Brent | 277/165 |

FOREIGN PATENT DOCUMENTS

| | | | |
|---|---|---|---|
| 2240408 | 8/1972 | Fed. Rep. of Germany | 277/165 |

OTHER PUBLICATIONS

"Schwenkmotoren HYD-RO-AC", Bird-Johnson, Luftfahrt-Technik GmbH, 4000 Dusseldorf, BRD.

*Primary Examiner*—Robert I. Smith

*Attorney, Agent, or Firm*—Walter C. Farley

[57] ABSTRACT

A sealing arrangement for a hydraulic device includes two sliding seals, one on a wing member attached to a shaft to slidingly ride against the inside wall of a chamber, and the other on a stop member attached to the chamber wall to ride against the shaft. Each member includes a groove containing a U-shaped slider and a U-shaped resilient seal, the seal being between the slider and the bottom of the groove to urge the slider outwardly. Each seal has a projection at the ends of the legs on which the ends of the slider legs rest. The seal on the stop member has a connecting link.

7 Claims, 6 Drawing Figures

ROTARY APPARATUS FLUID SEALING SYSTEM

This invention relates to a rotary apparatus and, more specifically, to a sealing and sliding assembly for use therein.

BACKGROUND OF THE INVENTION

In an apparatus which involves a cylindrical housing containing a rotatable shaft and a wing protruding from the shaft and engaging the interior of the housing such that the wing is movable with the shaft back and forth under the influence of fluid pressure, it is necessary to provide some form of sealing arrangement between the wing and the interior of the housing to maintain fluid pressure integrity. It is also necessary to provide a seal between the shaft and a stop member which limits the rotational movement of the wing.

In a known apparatus of this general type, a slider intended for use on the rotatable wing and a sealing body intended for use with it have a circular enlargement at the ends of the legs which serves the purpose of securing the body in a corresponding recess in the rotary wing. As a result of this, a positive connection between the rotary wing on one side and the sealing body and the slider on the other side is achieved. On the stop body, a sealing body is in the form of an O-ring and its slider is formed as a rectangularly shaped frame. The O-ring and the frame are disposed such that they lie in a radial plane.

BRIEF SUMMARY OF THE INVENTION

An object of the present invention is to form the slider and the sealing member so that they are suitable for use in both the stop body and the rotatable wing so that the inventory of different kinds of devices can be drastically reduced.

A further object is to produce these members so that the sealing body exerts a force to press the slider in both the stop body and the wing resiliently against its associated sliding surface.

Briefly described, the invention comprises an improved fluid sealing system for a rotatable apparatus of the type having a housing with a cylindrical chamber wall, a coaxial shaft in said chamber, a stop member attached to the housing in the chamber and slidably engaging the shaft, a wing member attached to the shaft and slidably engaging the chamber wall, and receiving grooves in the stop member and wing member for receiving sealing devices, the sealing system comprising first and second U-shaped sliders receivable in the receiving grooves in said stop and wing members, respectively, and having an exposed surface for slidingly contacting a surface of said shaft and chamber wall, respectively; and first and second generally U-shaped sealing bodies of elastomeric material, one of said bodies being insertable between each of said sliders and its associated member; each of said sealing bodies including an axially outwardly projecting support at the end of each leg for abutting the ends of the legs of its associated slider and for elastically urging the exposed surface of said slider toward the surfaces of one of said shaft and chamber wall.

As will be seen, the sliders which are intended for use in either the stop body or the rotary wing are always formed the same, and the sealing body which is usable in either the stop member or the rotatable wing is similarly formed in the same fashion, at least up to a point in the production process which immediately precedes final assembly. The slider and the sealing body are of a simple form of construction and therefore can be produced, installed and stored in a simple fashion. The inventory is considerably simplified because it is possible to store similarly formed sealing bodies for the stop body and the rotatable wing. Because, as will be seen, the ends of the slider are supported under prestress on the supporting parts of the elastic sealing body, the slider is automatically readjusted in accordance with the wear which occurs during operation.

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF PREFERRED EMBODIMENTS

Figure 1:
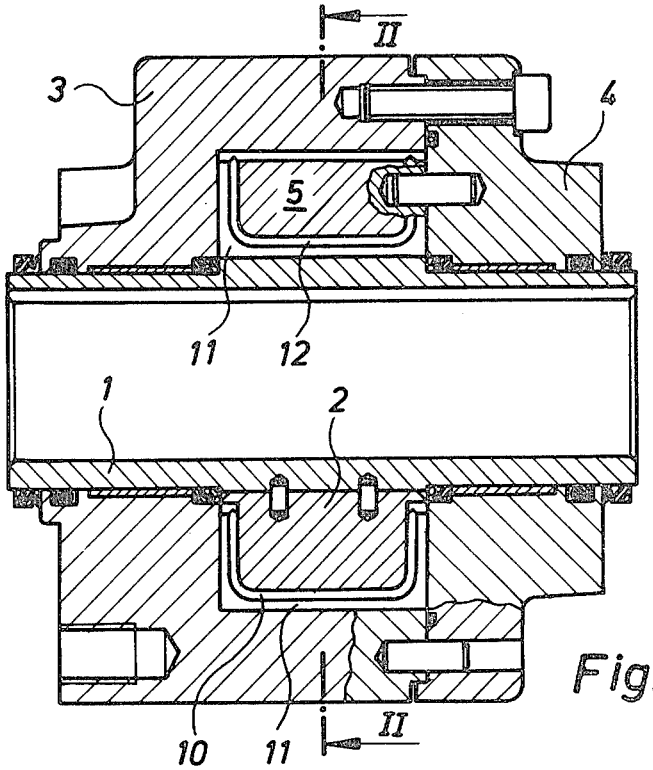
FIG. 1 is a side elevation in longitudinal section through a rotatable hydraulic apparatus incorporating the present invention, the section being along line I—I of FIG. 2.
Figure 2:
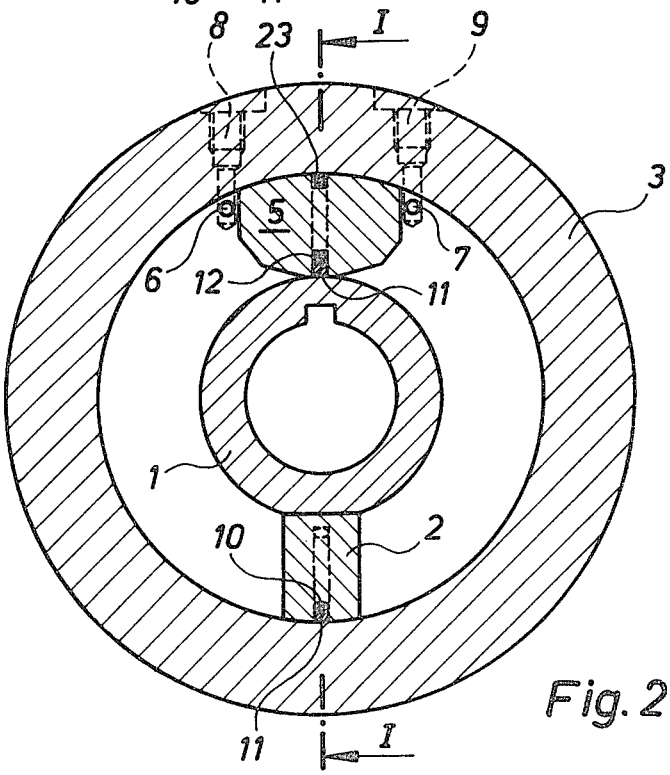
FIG. 2 is an end elevation, in section, along line II—II of FIG. 1.

As shown in FIGS. 1 and 2, a hydraulic apparatus of the type in which the invention can be used includes a rotatably mounted hollow shaft 1 which carries a rotatable wing 2 which is fixedly attached to the shaft and rotatable therewith, the wing occupying the radial clearance between the outer surface of shaft 1 and the inner cylindrical surface of a chamber in housing 3 such that the outer radial limit of the wing reaches the chamber wall. Shaft 1 is rotatably mounted in the housing 3 at one end and in a housing cover 4 at the other end, cover 4 being connected to housing 3 by releasable screws. Between shaft 1 and housing 3 is a stop body 5 which bridges the radial clearance therebetween, body 5 being fixedly attached to the chamber wall in housing 3. On either side of body 5 are bores 6 and 7 which extend into the ends of housing 3 to deliver fluid under pressure, bores 6 and 7 being coupled by channels to connections 8 or 9 which are accessible from the outside and which are normally alternatingly connectable to a source of fluid under pressure so that wing 2 is rotatably driven in one direction or the other. As will be recognized, the system can be reversed so that rotation of the shaft creates a pressure condition at one of the bores 6, 7.

The outer portion of wing 2 has a receiving groove which is rectangular in cross section and which contains a U-shaped sealing body 10 and which also contains a U-shaped slider 11. The sealing body 10 and slider 11, viewed in the axial direction, lie one upon the other such that the slider is pressed elastically or resiliently against the cylindrical chamber wall which is the interior of housing 3.

Stop body 5 has a receiving groove which extends around its entire circumference in a radial plane and is intended for the reception of a slider 11, formed in the same fashion as the slider on the wing 2, and a sealing body 12, the receiving groove being less deep on the radial outside portion adjacent the inner surface of housing 3 than on the radial inner portion which faces the shaft.

Figure 3:
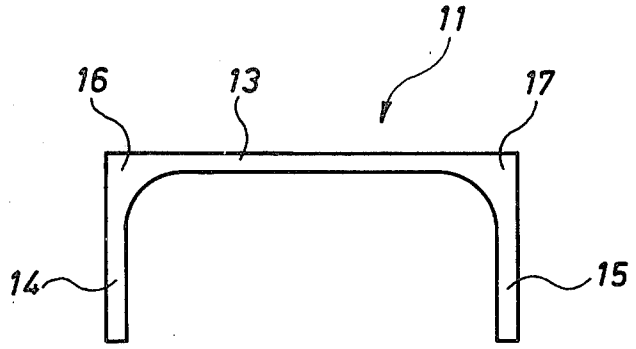
FIG. 3 is a side elevation of a slider in accordance with the invention usable in the apparatus of FIGS. 1 and 2.

The slider 11 is shown in FIG. 3. It has a mid-portion 13 and two legs 14 and 15 as well as corner regions 16 and 17. The middle portion 13 and the legs 14, 15 have the same rectangular shape in cross section. The corner areas are rectangularly shaped on the outside but the inwardly facing portions of the corners are rounded to conform to the shape of wing 12 or body 5 in the receiving groove. Thus, the slider 11 fits with very small clearance of motion into the receiving groove in either the wing 2 or body 5.

Figure 4:
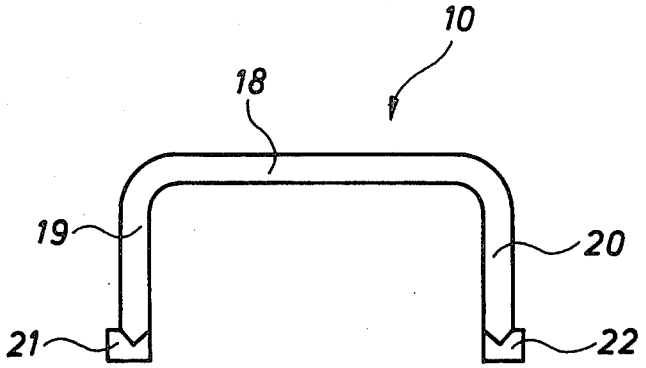
FIGS. 4 and 5 are side elevations of sealing members in accordance with the invention usable in the apparatus of FIGS. 1 and 2.

The sealing body 10, which is inserted under prestress into the receiving groove in the rotary wing 2 between the groove and the slider 11, is shown in FIG. 4. The sealing body is U-shaped having a middle part 18 and two legs 19 and 20. At the ends of the legs 19, 20 are supporting parts 21 and 22 which protrude perpendicularly to the outside. The cross sections of the middle part 18 and of legs 19 and 20, as well as of the supporting parts 21, 22, are circular and have equal diameters. The supporting parts 21 and 22 protrude to the outside beyond legs 19, 20 in such a way that the ends of the legs 14, 15 of the slider can stand on the protrusions under prestress.

Figure 5:
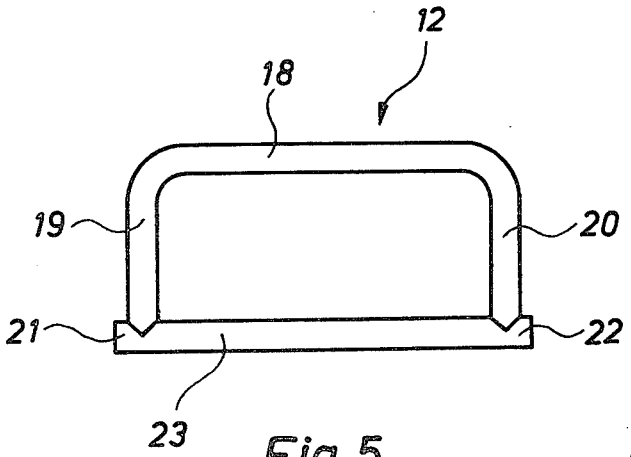
Figure 6:
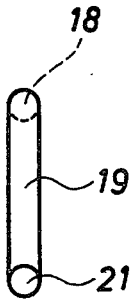
FIG. 6 is an end elevation of the sealing body of FIG. 5.

The sealing body 12 is shown in FIG. 5 and has, in addition to the portions discussed in connection with FIG. 4, a connecting link 23 which extends between and is coaxial with the supporting parts 21, 22, link 23 thus interconnecting the ends of legs 19, 20. When installed, link 23 is positioned between the stop body 5 and the inner surface of housing 3, on the radial outer portion of the receiving groove in body 5.

Slider 11 is made of a working material with good sliding characteristics and high abrasion resistance. A particularly suitable material is polytetrafluoroethylene (TEFLON) filled with glass fibers, carbon fibers, carbon particles or bronze additives, or with two or more of these components. The sealing bodies 10 and 12 are made of an elastomeric working material such as rubber or polyamide.

The sealing body 12 is produced in an apparatus suitable for this purpose, such as an injection molding apparatus. The sealing body 10 can be produced in the same apparatus with the insertion of a core corresponding to the connecting link 23 so that that link is simply omitted when the body 10 is produced. It is alternatively possible to produce all of the sealing bodies so that they are formed with the connecting link 23 as shown in FIG. 5, after which the link can simply be severed from those members which are to be used in connection with the wing 2 by means of a cutting process. Because the middle link does not need to be cut out until immediately prior to installation in the apparatus, this permits great reduction in the inventory of components and involves a minor loss of material.

The slider 11 and its associated sealing body 10 or 12 are inserted in such a way that the sealing body 10, 12 is under prestress and therefore attempts to urge the slider 11 toward its associated sliding surface, either the interior of housing 3 or the exterior of shaft 1. The corner areas 16 and 17 of the slider 11, being rounded on the inside, correspond to the rounded-off corner areas of the receiving grooves, thereby permitting a good fit of the sealing body 10 or 12 along with the associated slider.

While certain advantageous embodiments have been chosen to illustrate the invention, it will be understood by those skilled in the art that various changes and modifications can be made therein without departing from the scope of the invention as defined in the appended claims.

What is claimed is:

1. An improved fluid sealing system for a rotatable apparatus of the type having a housing with a cylindrical chamber wall, a coaxial shaft in said chamber, a stop member attached to the housing in the chamber and slidably engaging the shaft, a wing member attached to the shaft and slidably engaging the chamber wall, and receiving grooves in the stop member and wing member for receiving sealing devices, the sealing system comprising first and second U-shaped sliders receivable in the receiving grooves in said stop and wing members, respectively, and having an exposed surface for slidingly contacting a surface of said shaft and chamber wall, respectively; and first and second generally U-shaped sealing bodies of elastomeric material, one of said bodies being insertable between each of said sliders and its associated member;

each of said sealing bodies including an axially outwardly projecting support at the end of each leg for abutting the ends of the legs of its associated slider and for elastically urging the exposed surface of said slider toward the surfaces of one of said shaft and chamber wall.

2. A sealing system according to claim 1 wherein each of said outwardly projecting supports has the same cross section as that of the rest of said sealing body.

3. A sealing system according to claim 2 wherein the legs and central portion of each U-shaped slider are of substantially uniform cross section, and wherein the outside of each corner is substantially square and the inside of each corner is rounded.

4. A sealing system according to claim 3 wherein the one of said sealing bodies on said stop member includes a connecting link extending coaxially between said projecting supports.

5. A sealing system according to claim 2 wherein the one of said sealing bodies on said stop member includes a connecting link extending coaxially between said projecting supports.

6. A sealing system according to claim 1 wherein the one of said sealing bodies on said stop member includes a connecting link extending coaxially between said projecting supports.

7. A sealing system according to claim 1 wherein the legs and central portion of each U-shaped slider are of substantially uniform cross section, and wherein the outside of each corner is substantially square and the inside of each corner is rounded.

* * * * *